US005918095A

United States Patent [19]

Huang

[11] Patent Number: 5,918,095

[45] Date of Patent: Jun. 29, 1999

[54] DEVELOPER DISPENSING CONTAINER

[75] Inventor: Ya-Li Huang, Taichung County, Taiwan

[73] Assignee: General Plastic Industrial Co., Ltd., Taichung County, Taiwan

[21] Appl. No.: 09/150,624

[22] Filed: Jul. 29, 1998

[51] Int. Cl.[6] ..... G03G 15/08

[52] U.S. Cl. ..... 399/263; 222/DIG. 1

[58] Field of Search ..... 222/DIG. 1, 43, 222/129, 325, 564; 399/110, 111, 114, 252, 258, 262, 263

[56] References Cited

U.S. PATENT DOCUMENTS

| | | | |
|---|---|---|---|
| 5,774,772 | 6/1998 | Kai et al. | 399/260 |
| 5,774,773 | 6/1998 | Otsuka et al. | 399/262 |
| 5,812,916 | 9/1998 | Kishimoto et al. | 399/263 |

*Primary Examiner*—Arthur T. Grimley
*Assistant Examiner*—Hoang Ngo
*Attorney, Agent, or Firm*—Pro-Techtor InterNational Services

[57] ABSTRACT

A developer dispensing container includes a container body covered with a container cap, a dispensing nozzle suspended in the container body with a nozzle tube extended out of the center hole on the container cap, a nozzle cap mounted around the nozzle tube and moved along longitudinal sliding grooves at the nozzle tube to close/open the nozzle tube, a rotary driving member coupled to the nozzle cap and driven to move the nozzle cap along the longitudinal sliding grooves of the nozzle tube, and a stirrer revolvably supported on an axle bearing inside the container body and rotated with the dispensing nozzle when the nozzle cap is opened from the nozzle tube and the rotary driving member is continuously rotated.

8 Claims, 5 Drawing Sheets

DEVELOPER DISPENSING CONTAINER

BACKGROUND OF THE INVENTION

The present invention relates to a developer dispensing container for use in a copier, facsimile apparatus, printer or similar electrophotographic image forming apparatus, and more particularly to such a developer dispensing container which comprises developer stirrer means, and dispensing control cap means.

"U.S. Pat. No. 5,500,719 discloses a developer replenishing device and a developer container for use with the developer replenishing device. According to U.S. Pat. No. 5,500,719, a developer holder is provided the replenishing device to hold the developer container. The developer container has a mouth portion at one end thereof. The developer holder allows a developer to be discharged from the mouth portion of the developer container into the developer replenishing device. However, the mechanism which is provided and controlled to open the developer container is complicated and expensive, and tends to be damaged. Further, the developer container has spiral guide means on the inside of the main body thereof for guiding the developer to a mouth portion at one end of the main body upon a rotary motion of the developer container. When the developer container is continuously rotated, static electricity may be produced inside the main body of the developer container, causing the developer to be adhered to the surface of the inside wall and the spiral guide means, therefore the contained developer cannot be fully consumed.

SUMMARY OF THE INVENTION

The present invention has been accomplished to provide a developer dispensing container which eliminates the aforesaid drawbacks. It is one object of the present invention to provide a developer dispensing container which can easily be opened to let the contained developer to be discharged out of the container body thereof. It is another object of the present invention to provide a developer dispensing container which enables the contained developer to be fully consumed. To achieve these and other objects, there is provided a developer dispensing container comprised of a container body covered with a container cap, a dispensing nozzle suspended in the container body with a nozzle tube extended out of the center hole on the container cap, a nozzle cap mounted around the nozzle tube and moved along longitudinal sliding grooves at the nozzle tube to close/open the nozzle tube, a rotary driving member coupled to the nozzle cap and driven to move the nozzle cap along the longitudinal sliding grooves of the nozzle tube, and a stirrer revolvably supported on an axle bearing inside the container body and rotated with the dispensing nozzle en the nozzle cap is opened from the nozzle tube and the rotary driving member is continuously rotated.

DETAILED DESCRIPTION OF THE PREFERRED EMBODIMENT

Figure 1:
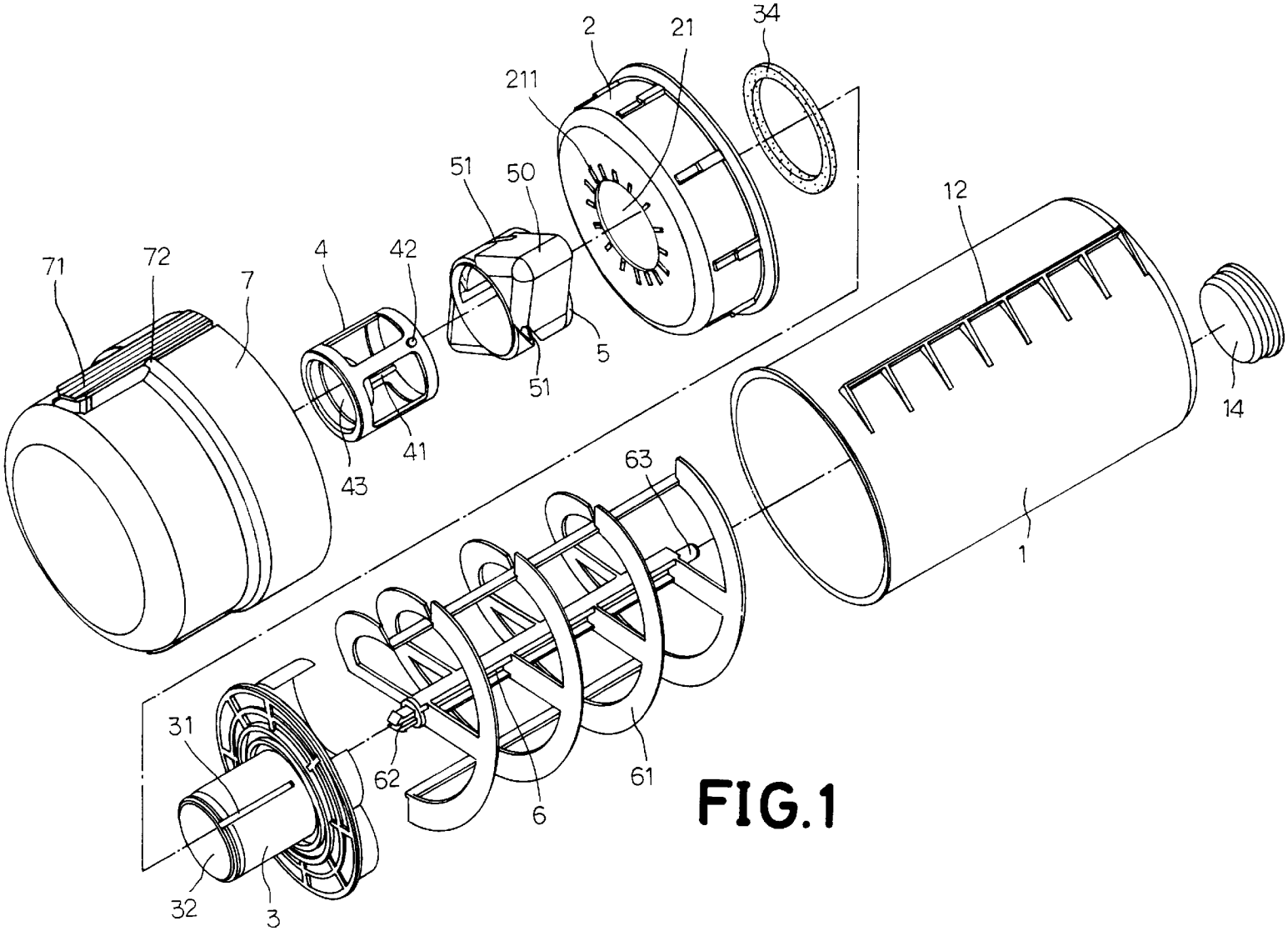
FIG. 1 is an exploded view of a developer dispensing container according to the present invention.
Figure 2:
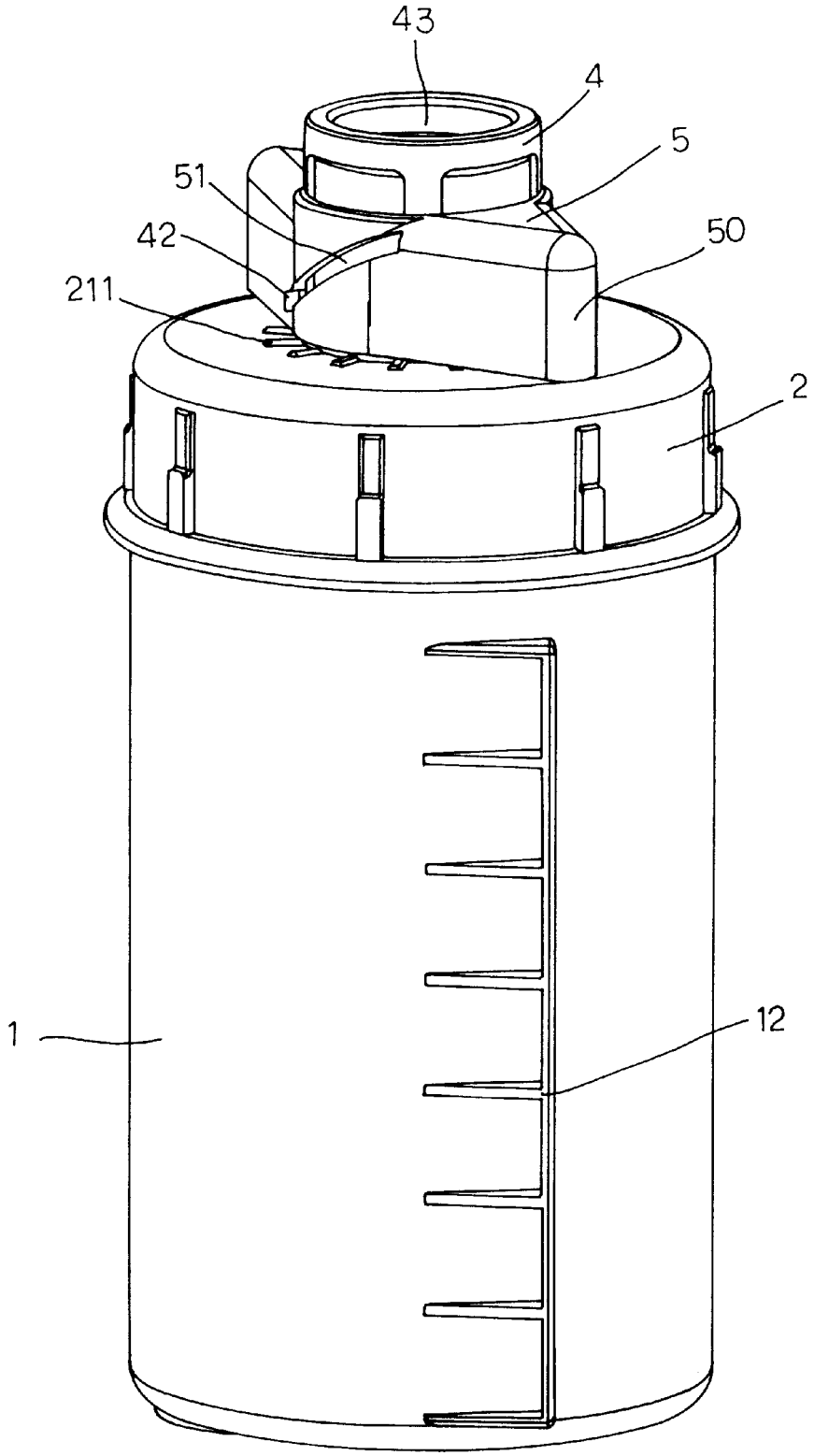
FIG. 2 is a perspective view of the developer dispensing container according to the present invention (the cover excluded).

Referring to FIG. 1, a developer dispensing container in accordance with the present invention is generally comprised of a container body 1, a container cap 2, a dispensing nozzle 3, a nozzle cap 4, a rotary driving member 5, a stirrer 6, and a cover 7.

Figure 3:
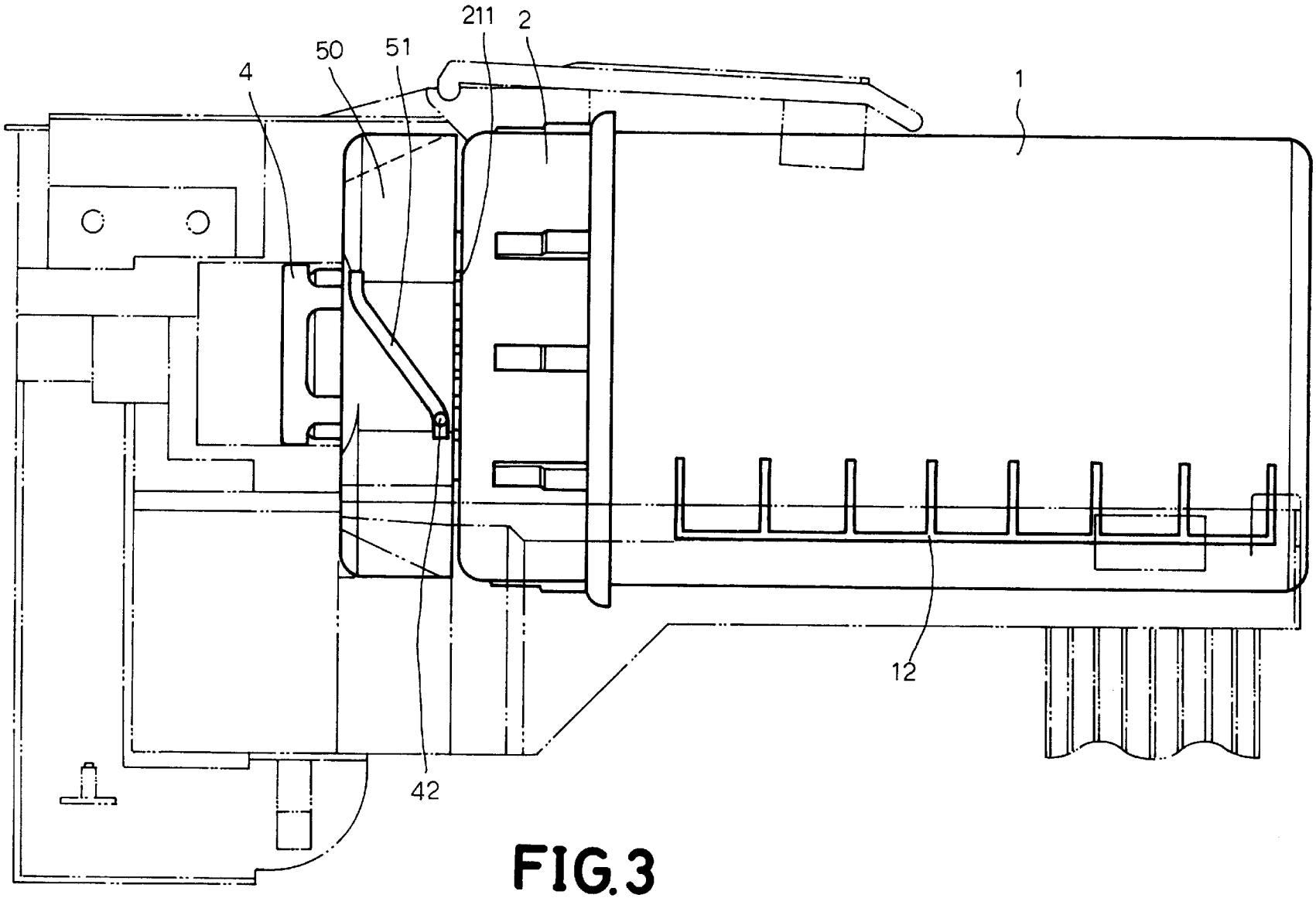
FIG. 3 is a side plain view showing the developer dispensing container installed in a copier according to the present invention.
Figure 4:
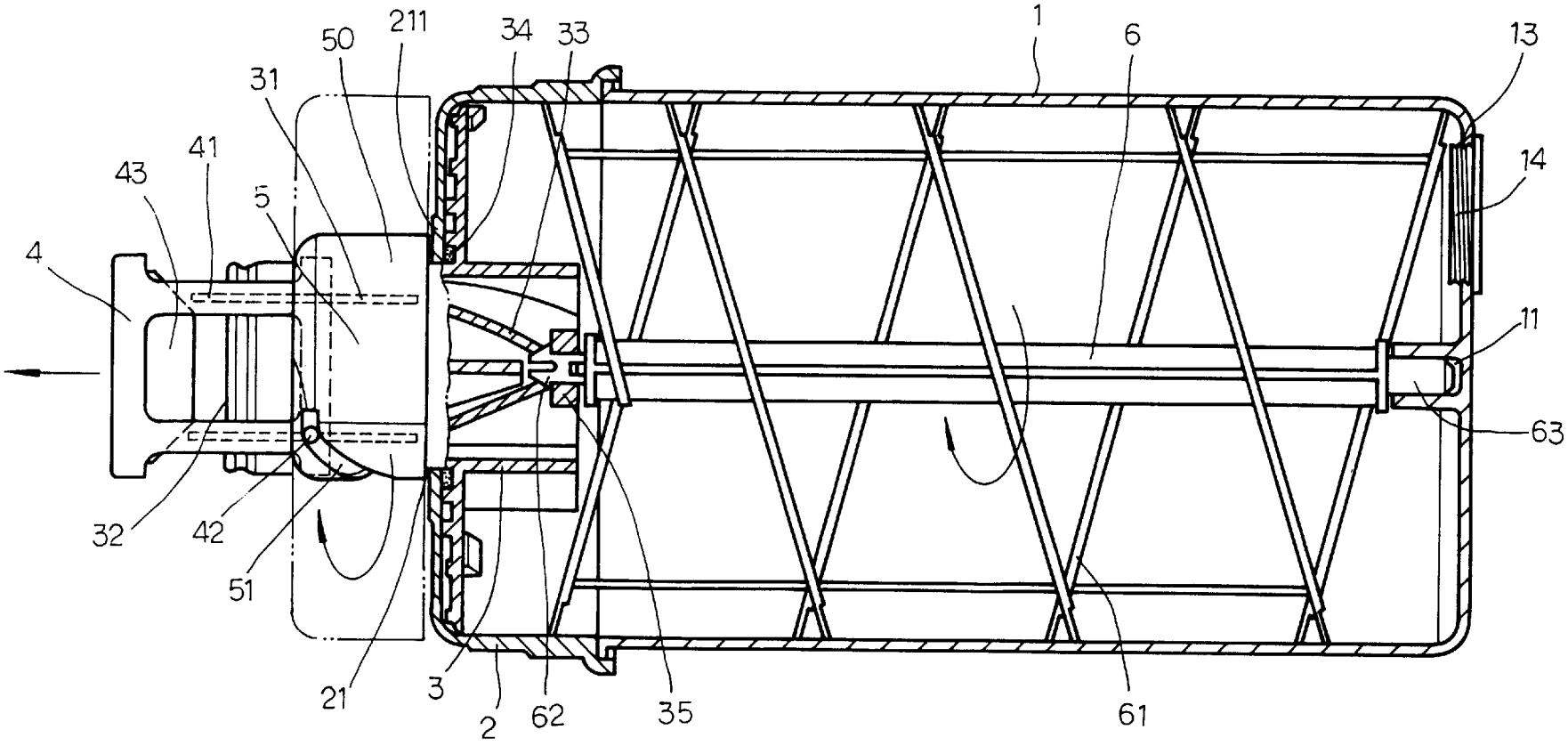
FIG. 4 shows the rotary driving member rotated, the nozzle cap opened from the nozzle tube according to the present invention.

Referring to FIGS. 3 and 4 and FIG. 1 again, the container body 1 comprises an axle bearing 11 at the center of the bottom wall thereof on the inside, a threaded filling hole 13 at the bottom wall through which a developer (carbon powder) is filled into the container body 1, a screw cap 14 fastened to the filling hole 13 to close the passage, and positioning ribs 12 raised from the outside wall thereof for positioning in for example a copier.

Referring to FIGS. 1 and 4 again, the container cap 2 comprises a center hole 21, and a plurality of radial ribs 211 raised from the top side wall thereof around the center hole 21 which produce less friction resistance when the rotary driving member 5 is rotated above the container cap 2.

Referring to FIGS. 1 and 4 again, the dispensing nozzle 3 comprises a nozzle tube 32 at the front end thereof, a plurality of longitudinal sliding grooves 31 equiangularly spaced around the outside wall of the nozzle tube 32, a developer guide 33 at the rear end thereof for guiding the developer (carbon powder) from the container body 1 to the nozzle tube 32, and a hook hole 35 at one end of the developer guide 33 remote from the nozzle tube 32.

Referring to FIG. 1 again, the nozzle cap 4 comprises a hollow rounded top panel 43 at the front end thereof, a plurality of longitudinal rails 41 equiangularly spaced around the inside wall thereof, and two stub rods 42 raised from the periphery at two opposite sides near the bottom end thereof.

Referring to FIGS. 1 and 3 again, the rotary driving member 5 comprises two opposite wings 50 and two opposite spiral guide slots 51. The axis which passes through the center of the spiral guide slots 51 is perpendicular to the axis which passes through the center of the wings 50.

Referring to FIG. 1 again, the stirrer 6 comprises a plurality of spirally arranged stirring blades 61, a front hook 62 forwardly raised from the center of the front end thereof, and a rear coupling axle 63 backwardly raised from the center of the rear end thereof.

Figure 5:
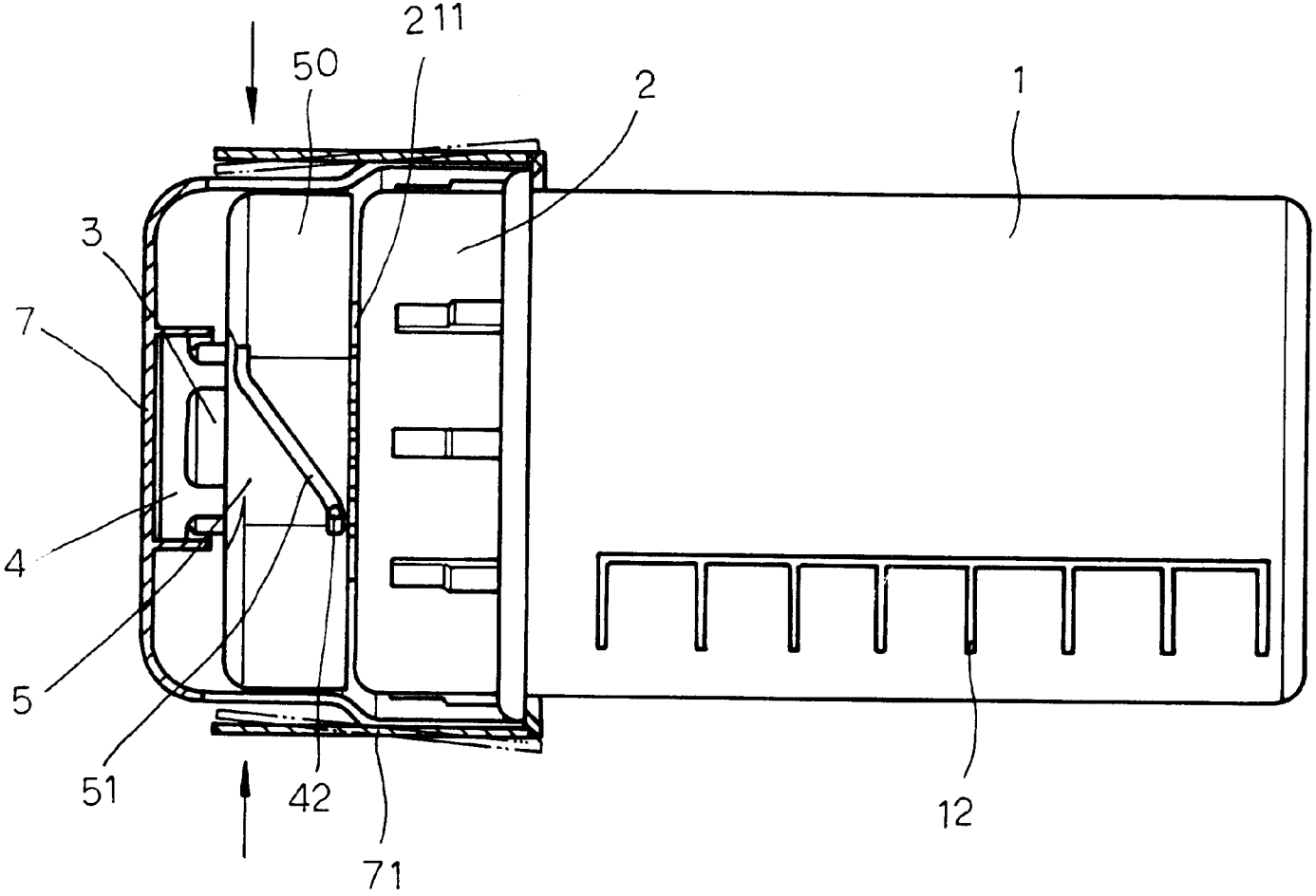
FIG. 5 is a schematic drawing showing the cover covered on the container cap, the hooks of the cover hooked on the container cap according to the present invention.

Referring to FIG. 5 and FIG. 1 again, the cover 7 comprises two hooks 71 longitudinally bilaterally connected to the cover body thereof. The hooks 71 each have a flange 72 on the middle integral with the cover body of the cover 7. When the top ends of the hooks 71 are respectively pressed inwards, the hooked bottom ends of the hooks (71) are turned outwards, therefore the hooks 71 can be conveniently hooked on the bottom edge of the container cap 2 when the cover 7 is covered on the container cap 2.

Referring to FIGS. 1 and 4 again, the container cap 2 is covered on one end of the container body 1 remote from the axle holder 11. The dispensing nozzle 3 is mounted inside the container body 1 with the nozzle tube 32 extended out of the center hole 21 on the container cap 2. The nozzle cap 4 is fastened to the nozzle tube 32 of the dispensing nozzle 3 outside the container cap 2 by inserting the longitudinal rails 41 into the sliding grooves 31 respectively. When the nozzle cap 4 and the dispensing nozzle 3 are connected together, the hollow rounded top panel 43 of the nozzle cap 4 is attached to the front end of the nozzle tube 32 to close the passage of the nozzle tube 32. The rotary driving member 5 is mounted around the nozzle cap 4 and supported on the radial ribs 211 of the container cap 2. When the rotary driving member 5 is sleeved onto the nozzle cap 4, the stub rods 42 of the nozzle cap 4 are respectively forced into the spiral guide slots 51 on the rotary driving member 5. The stirrer 6 is mounted inside the container body 1 with the front hook 62 hooked in the hook hole 35 on the dispensing nozzle 3 and the rear coupling axle 63 inserted into the axle bearing 11. When installed, the stirrer 6 can be rotated with the dispensing nozzle 3. Further, a seal ring 34 is mounted around the nozzle tube 32 and stopped between the inside wall of the container cap 2 and the outside wall of the dispensing nozzle 3 to seal the gap.

When the rotary driving member 5 is rotated in one direction by the driving mechanism of the copier, the nozzle cap 4 is forced to move forwards along the longitudinal sliding grooves 31, thereby causing the hollow rounded top panel 43 to be moved with the nozzle cap 4 from the front end of the nozzle tube 32, and therefore the dispensing nozzle 3 is opened. On the contrary when the rotary driving member 5 is rotated in the reversed direction, the nozzle cap 4 is moved backwards along the longitudinal sliding grooves 31 to close the nozzle tube 32. When the rotary driving member 5 is continuously rotated by the driving mechanism of the copier after the nozzle cap 4 has been opened from the nozzle tube 32, the dispensing nozzle 3 and the stirrer 6 are rotated with the nozzle cap 4, causing the contained developer (carbon powder) to be mixed and propelled out of the nozzle tube 32 of the dispensing nozzle 3 by the stirrer 6.

What the invention claimed is:

1. A developer dispensing container comprising:

a container body having an opened first end and a closed second end;

a container cap covered on the opened first end of said container body, said container cap having a center hole;

a dispensing nozzle suspended in said container body and stopped inside said container body by said container cap, said dispensing nozzle comprising a nozzle tube extended out of the center hole on said container cap and a plurality of longitudinal sliding grooves equiangularly spaced around the periphery of said nozzle tube;

a nozzle cap mounted around said nozzle tube of the dispensing nozzle outside said container cap, said nozzle cap comprising a hollow rounded top panel at a front end thereof for closing said nozzle tube of said dispensing nozzle, a plurality of longitudinal rails equiangularly spaced around an inside wall thereof and respectively inserted into the longitudinal sliding grooves on said nozzle tube, and two stub rods raised from the periphery at two opposite sides near a bottom end thereof; and a rotary driving member coupled to said nozzle cap and driven to move said nozzle cap along the longitudinal sliding grooves of said nozzle tube between a first position where the hollow rounded top panel of said nozzle cap is closed on said nozzle tube, and a second position where the hollow rounded top panel of said nozzle cap is moved away from said nozzle tube, said rotary driving member comprising two opposite spiral guide slots respectively coupled to the stub rods of said nozzle cap.

2. The developer dispensing container of claim 1 further comprising a stirrer revolvably supported on an axle bearing inside said container body, said stirrer comprising a plurality of spirally arranged stirring blades, a front end fixedly connected to said dispensing nozzle, and a rear end supported on an axle bearing inside said container body.

3. The developer dispensing container of claim 1 further comprising a cover for covering on said container cap over said nozzle cap, said cover having two hooks at two opposite sides for hooking on a bottom edge of said container cap.

4. The developer dispensing container of claim 1 wherein said dispensing nozzle omprises a developer guide at a bottom side thereof for guiding a developer from said container body to said nozzle tube.

5. The developer dispensing container of claim 1 further comprising a seal ring mounted around said nozzle tube and stopped between an inside wall of said container cap and an outside wall of said dispensing nozzle.

6. The developer dispensing container of claim 1 wherein said container body has positioning means on the outside for positioning.

7. The developer dispensing container of claim 1 wherein said container body comprises a filling hole hrough which a developer is filled into said container body, and cap means closed on said filling hole.

8. The developer dispensing container of claim 1 wherein said container cap comprises a plurality of radial ribs raised from an outside wall thereof around the center hole thereof.

* * * * *